US010363746B2

(12) United States Patent
Ishizuka

(10) Patent No.: US 10,363,746 B2
(45) Date of Patent: Jul. 30, 2019

(54) METHOD FOR PRODUCING LIQUID EJECTION HEAD

(71) Applicant: CANON KABUSHIKI KAISHA, Tokyo (JP)

(72) Inventor: Kazunari Ishizuka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 83 days.

(21) Appl. No.: 15/831,730

(22) Filed: Dec. 5, 2017

(65) Prior Publication Data

US 2018/0170055 A1 Jun. 21, 2018

(30) Foreign Application Priority Data

Dec. 20, 2016 (JP) ..... 2016-247025

(51) Int. Cl.
*B41J 2/05* (2006.01)
*B41J 2/16* (2006.01)

(52) U.S. Cl.
CPC ..... *B41J 2/1631* (2013.01); *B41J 2/1601* (2013.01); *B41J 2/1603* (2013.01); *B41J 2/1607* (2013.01); *B41J 2/1629* (2013.01); *B41J 2/1639* (2013.01); *B41J 2/1645* (2013.01); *B41J 2202/03* (2013.01)

(58) Field of Classification Search
CPC .... B41J 2/1631; B41J 2/1639; B41J 2202/03; B41J 2/1601; B41J 2/1603; B41J 2/1607; B41J 2/1629; B41J 2/1645
USPC ..... 430/320
See application file for complete search history.

(56) References Cited

U.S. PATENT DOCUMENTS

| | | | |
|---|---|---|---|
| 4,565,859 | A | 1/1986 | Murai et al. |
| 4,841,017 | A | 6/1989 | Murai et al. |
| 5,478,606 | A | 12/1995 | Ohkuma et al. |
| 7,550,252 | B2 | 6/2009 | Shimimura et al. |
| 7,682,779 | B2 | 3/2010 | Ishizuka |
| 8,105,761 | B2 | 1/2012 | Ikeda et al. |
| 2009/0162797 | A1 | 6/2009 | Tsuji et al. |
| 2010/0255422 | A1 | 10/2010 | Ishizuka et al. |

FOREIGN PATENT DOCUMENTS

| | | | |
|---|---|---|---|
| JP | 60-161973 | A | 8/1985 |
| JP | 63-221121 | A | 9/1988 |
| JP | 64-9216 | A | 1/1989 |
| JP | 2-140219 | A | 5/1990 |
| JP | 6-286149 | A | 10/1994 |
| JP | 2009-166492 | A | 7/2009 |
| JP | 2009-172900 | A | 8/2009 |

*Primary Examiner* — John A McPherson
(74) *Attorney, Agent, or Firm* — Venable LLP

(57) ABSTRACT

A method for producing a liquid ejection head includes a step of providing a positive photosensitive resin layer on a substrate, a step of heat-treating the positive photosensitive resin layer on the substrate, and a step of forming a mold material having a pattern of the flow path by subjecting the heat-treated positive photosensitive resin layer on the substrate to exposure and development. In the method, the positive photosensitive resin layer includes a light absorbing agent that is nonvolatile at a temperature of the heat treatment of the positive photosensitive resin layer, the light absorbing agent has a light absorbance (a1) at a wavelength of 365 nm and an average light absorbance (a2) in a wavelength range of 280 nm or more to 330 nm or less, and an absorbance ratio A is 1.0 or less where the absorbance ratio A is the ratio a2/a1.

12 Claims, 3 Drawing Sheets

METHOD FOR PRODUCING LIQUID EJECTION HEAD

BACKGROUND OF THE INVENTION

Field of the Invention

The present invention relates to a method for producing a liquid ejection head.

Description of the Related Art

Liquid ejection heads are used for recording on recording media with inks by an ink jet recording method and for applying a surface treatment liquid onto a surface to be treated, for example. A typical ink jet recording head applied to the ink jet recording method (liquid jet recording method) includes a plurality of fine ejection ports, flow paths communicating with the ejection ports, and energy generating elements that generates energy for ejecting an ink from the ejection ports. A conventionally known method of producing such an ink jet recording head uses a photolithographic technique.

Japanese Patent Application Laid-Open No. H06-286149 discloses a method for producing an ink jet recording head including the following steps.

- A step of forming an ink flow path pattern of a soluble resin on a substrate having an ink ejection pressure generating element.
- A step of forming a coating resin layer serving as an ink flow path wall on the soluble resin layer by subjecting a solution dissolving a coating resin including an epoxy resin that is solid at ordinary temperatures in a solvent to solvent-coating on the soluble resin layer.
- A step of forming an ink ejection port in the coating resin layer above the ink ejection pressure generating element.
- A step of dissolving the soluble resin layer.

From the viewpoint of higher speed recording and higher image quality, the liquid ejection head has been required to have ejection ports with a smaller opening size and to have a structure in which fine ejection ports with a smaller opening size and flow paths communicating with the ejection ports are arranged at a higher density.

To form a member having ejection ports and flow paths of a liquid ejection head on a substrate, a negative photosensitive resin is used. To prepare a structure with fine ejection ports at a higher density by using the negative photosensitive resin, pattern exposure to i-line (365 nm) using a high precision and high illumination stepper has been studied for patterning of a negative photosensitive resin.

If highly precise formation of ejection ports by pattern exposure of a negative photosensitive resin to i-line is applied to the production of an ink jet recording head disclosed in Japanese Patent Application Laid-Open No. H06-286149, the following problem may be caused. In other words, an intended ejection port pattern shape may not be prepared depending on the pattern shape of a soluble resin as a flow path mold or the condition of a substrate surface. More specifically, even when, for example, a circular mask is used as the exposure mask for patterning of an ejection port, the actually formed ejection port may have a distorted circular shape, and a circular shape cannot be stably, reproducibly prepared for ejection ports in some cases. The main reason of the phenomenon is thought to be that the negative photosensitive resin has a high transmittance at the wavelength of the i-line and only the i-line is used for pattern exposure. In other words, it is thought that the i-line transmitting through a mold material made from the negative photosensitive resin reaches the substrate surface and the reflected light therefrom significantly affects the pattern exposure for preparing ejection ports. The phenomenon is significantly observed when ejection ports have a small opening size or flow paths are arranged at high density.

Japanese Patent Application Laid-Open No. 2009-166492 and Japanese Patent Application Laid-Open No. 2009-172900 disclose methods for producing an ink jet recording head in which a flow path pattern contains a light absorbing agent. In the production methods, light applied to the negative photosensitive resin for forming ejection ports is absorbed by a flow path pattern, thus the reflected light from a substrate is suppressed, and circular ejection ports can be stably prepared with sufficient reproducibility. When a particular light absorbing agent is added to the flow path pattern, a higher-density flow path pattern can be formed, and a problem of removal thereof is also solved. According to the production methods disclosed in Japanese Patent Application Laid-Open No. 2009-166492 and Japanese Patent Application Laid-Open No. 2009-172900, a photolithographic technique including exposure to i-line is used to enable production of an ink jet recording head having ejection ports with a satisfactory shape even when the ejection ports have a finer size.

SUMMARY OF THE INVENTION

The present invention is directed to provide a production method that enables mass production of liquid ejection heads including ejection ports having an intended shape with less contamination of a production apparatus or without reduction in production tact.

A method for producing a liquid ejection head of the present invention is a method for producing a liquid ejection head that includes a member having an ejection port and a flow path communicating with the ejection port and a substrate having an energy generating element configured to eject a liquid supplied from the flow path through the ejection port. The method includes a step of providing a positive photosensitive resin layer on a substrate, a step of heat-treating the positive photosensitive resin layer on the substrate, a step of forming a mold material having a pattern of the flow path by subjecting the heat-treated positive photosensitive resin layer on the substrate to exposure and development, a step of covering the mold material on the substrate with a negative photosensitive resin layer for forming the member, a step of forming the ejection port communicating with the mold material by subjecting the negative photosensitive resin layer covering the mold material to i-line irradiation and development treatment, and a step of forming the flow path communicating with the ejection port by removing the mold material from the substrate. In the method, the positive photosensitive resin layer includes a light absorbing agent that is nonvolatile at a temperature of the heat treatment of the positive photosensitive resin layer; and the light absorbing agent has a light absorbance (a1) at a wavelength of 365 nm and an average light absorbance (a2) in a wavelength range of 280 nm or more to 330 nm or less, and an absorbance ratio A is 1.0 or less where the absorbance ratio A is a ratio a2/a1.

Further features of the present invention will become apparent from the following description of exemplary embodiments with reference to the attached drawings.

DESCRIPTION OF THE EMBODIMENTS

Figure 1:
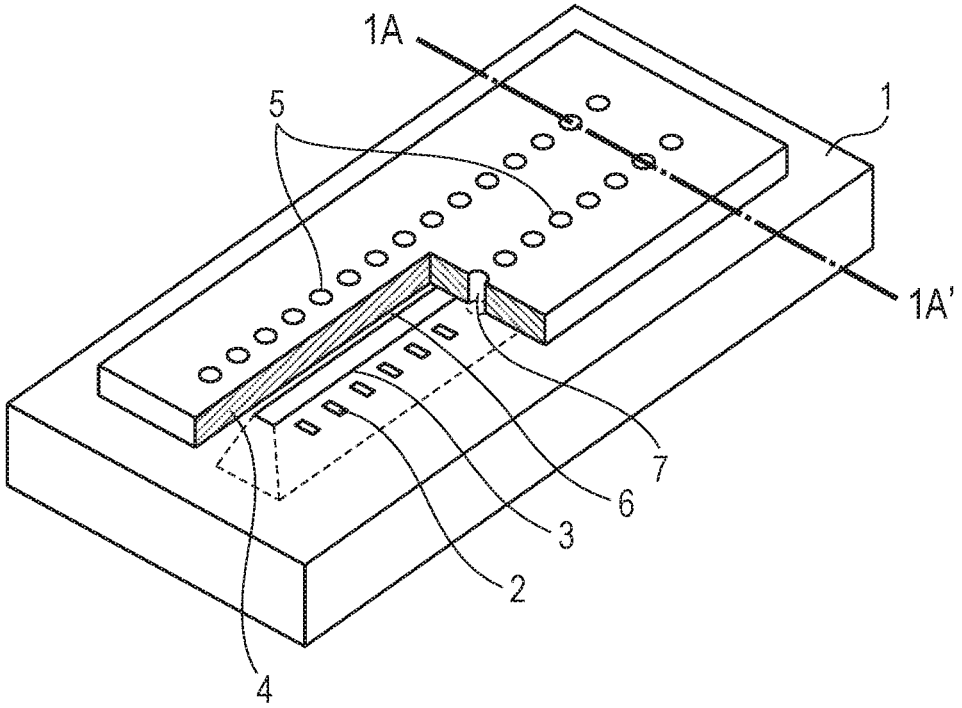
FIG. 1 is a schematic perspective view showing an ink jet recording head pertaining to an embodiment of the present invention.

Preferred embodiments of the present invention will now be described in detail in accordance with the accompanying drawings.

When a compound having a comparatively low boiling point such as 9,10-diethoxyanthracene [Chemical Formula (4)] exemplified in Japanese Patent Application Laid-Open No. 2009-166492 is used as a light absorbing agent that is added to a mold material of flow paths, the following problems may be caused.

(4)

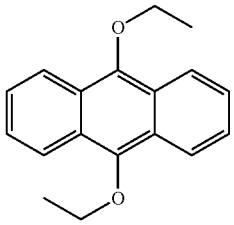

Specifically, when a positive photosensitive resin containing a light absorbing agent having a comparatively low boiling point is patterned in order to form a mold material of flow paths, the light absorbing agent can volatilize or sublimate during a baking step and may contaminate the inside of a baking furnace. If contaminants adhere to the cover of a baking furnace during mass production of liquid ejection heads, the apparatus downtime for cleaning and removing the contaminants may significantly affect a production tact.

When a benzophenone compound exemplified in Japanese Patent Application Laid-Open No. 2009-172900 is used as a light absorbing agent that is added to a mold material of flow paths, a larger exposure amount is required for patterning of a positive photosensitive resin due to the addition of the light absorbing agent. As the required exposure amount increases, the production tact decreases.

In contrast, the present invention enables simple preparation of ejection ports having an intended shape including an extremely satisfactory circular shape with sufficient reproducibility without contamination of a production apparatus even when a negative photosensitive resin is exposed to i-line to form fine ejection ports in a production process of a liquid ejection head. Consequently, liquid ejection heads having ejection ports formed with high precision can be mass produced without the reduction in production tact.

A liquid ejection head obtainable by a production method of the present invention includes a member having an ejection port and a flow path communicating with the ejection port and a substrate having an energy generating element configured to eject a liquid supplied from the flow path through the ejection port.

The method for producing a liquid ejection head of the present invention at least includes the following steps.

- A step of providing a positive photosensitive resin layer on a substrate.
- A step of heat-treating the positive photosensitive resin layer on the substrate.
- A step of forming a mold material having a pattern of the flow path by subjecting the heat-treated positive photosensitive resin layer on the substrate to exposure and development.
- A step of covering the mold material on the substrate with a negative photosensitive resin layer for forming the member having an ejection port and a flow path communicating with the ejection port.
- A step of forming the ejection port communicating with the mold material by subjecting the negative photosensitive resin layer covering the mold material to i-line irradiation and development treatment.
- A step of forming the flow path communicating with the ejection port by removing the mold material from the substrate.

The positive photosensitive resin layer contains a light absorbing agent that absorbs i-line and is nonvolatile at a temperature of the heat treatment of the positive photosensitive resin layer. As a result, the light absorbing agent does not volatilize from the mold material during heat treatment (also called baking treatment or prebaking treatment) of the positive photosensitive resin layer, and the contamination of the inside of a baking furnace by volatilization or sublimation of a light absorbing agent can be suppressed. In addition, the mold material contains the light absorbing agent that absorbs i-line, and thus when the negative photosensitive resin layer is exposed to i-line to form an ejection port, the reflection of the i-line from the substrate is suppressed, and patterning of the ejection port can be performed with high precision.

The present invention will now be specifically described with reference to drawings.

In the following description, an ink jet recording head (hereinafter also called "recording head") will be described as an application example of the liquid ejection head.

FIG. 1 is a schematic perspective view showing a cross section of a partially cut-out recording head pertaining to an embodiment of the present invention.

The recording head of the embodiment includes a substrate 1 made from silicon (Si) and having energy generating elements 2 that generate energy used for ejecting a liquid and are arranged at a certain pitch in two arrays. The substrate 1 has a supply port 3 that is formed by anisotropic etching of a part made from silicon and is an opening between two arrays of the energy generating elements 2. On the substrate 1, ejection ports 5 are formed on a member 4 at positions opposite to the corresponding energy generating elements 2. The member 4 has, in addition to the ejection ports 5, flow path 6 continuing from the supply port 3 to the corresponding ejection ports 5. In the example as shown in FIG. 1, the member 4 serves as both an ejection port forming member 4-1 and a flow path forming member 4-2. The position of each ejection port 5 is not limited to the position opposite to the corresponding energy generating element 2.

The recording head is placed in such a way that the face with the ejection ports 5 faces the recording surface of a recording medium. To an ink charged in a flow path 6 through the supply port 3, energy generated by an energy generating element 2 is applied, and ink droplets are ejected from an ejection port 5 and are attached to a recording medium, thereby performing recording. Examples of the energy generating element 2 include an electrothermal conversion element that generates thermal energy for ejecting droplets (what is called a heater) and a piezoelectric element that generates mechanical energy for ejecting droplets. The energy generating element 2 is not limited to these elements, and an element for any purpose can be selected and used.

Figure 2A:
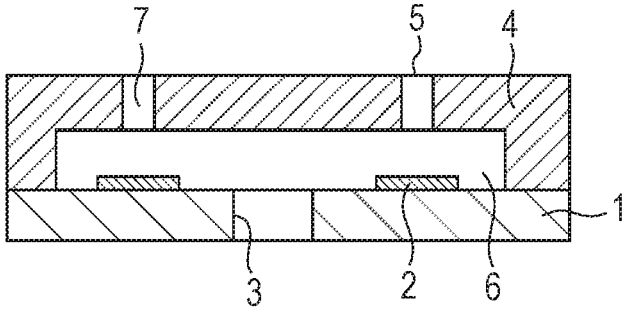
FIGS. 2A and 2B are schematic cross-sectional views each showing an ink jet recording head pertaining to an embodiment of the present invention.

FIG. 2A is a schematic cross-sectional view of the recording head taken along line 1A-1A' shown in FIG. 1.

As shown in FIG. 2A, each ejection port 5 is an opening on the surface of the member 4 and is called while separated from an ejection part 7 that is a passage part of a penetration port continuing from a flow path 6 to the ejection port 5. The ejection part 7 may have what is called a tapered shape in which the area of a section parallel to the substrate 1 (a section in the thickness direction of the substrate 1) is reduced from the substrate 1 side toward the ejection port 5.

Figure 2B:
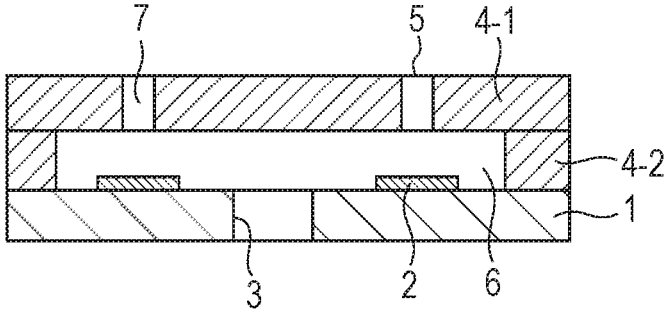

As shown in FIG. 2B, the member 4 may be composed of a member 4 constituting the ceiling of the flow path 6 and a member 4 constituting side walls of the flow path 6 between the member 4 constituting the ceiling and the substrate 1. In this case, the member 4 constituting the ceiling serves as an ejection port forming member 4-1, and the member 4 constituting the side walls serves as a flow path forming member 4-2.

Next, an exemplary method for producing a recording head as an embodiment of the present invention will be described with reference to FIGS. 3A to 3G.

FIGS. 3A to 3G are schematic cross-sectional views of a recording head in steps of an exemplary method for producing a recording head according to the invention, and are taken along line 1A-1A' in FIG. 1 as with FIG. 2A.

Figure 3A:
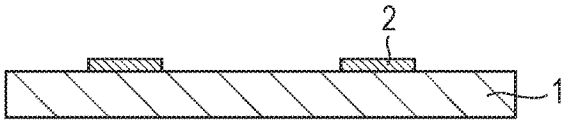
FIGS. 3A, 3B, 3C, 3D, 3E, 3F and 3G are schematic cross-sectional views showing a method for producing an ink jet recording head pertaining to an embodiment of the present invention.

As shown in FIG. 3A, a substrate 1 having energy generating elements 2 on the surface thereof is prepared first. The shape, the material, and the like of the substrate 1 is not particularly limited as long as the substrate 1 can serve as a part of a member constituting a flow path 6 and can serve as a support body of a member 4 forming the flow path 6 and ejection ports 5 described later. In the example, a supply port 3 penetrating the substrate 1 is subsequently formed by the anisotropic etching described later, and thus a silicon substrate is used.

On the substrate 1, an intended number of electrothermal conversion elements, piezoelectric elements, or similar elements are formed as energy generating elements 2. With the energy generating elements 2, energy for ejecting ink droplets is applied to an ink in the flow path 6, and recording is performed. When the energy generating element 2 is an electrothermal conversion element, the electrothermal conversion element heats the ink in the flow path 6 to cause a change in state of the ink, thereby generating ejection energy. When the energy generating element 2 is a piezoelectric element, mechanical vibration of the piezoelectric element generates ejection energy. Such an energy generating element 2 is connected to a control signal input electrode (not shown) for driving the element.

In some cases, various functional layers including a protective layer (not shown) for improving the durability of such an energy generating element 2 and an adhesion improvement layer (not shown) for improving the adhesion between the member 4 and the substrate 1 may be provided.

Figure 3B:
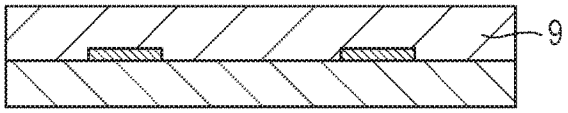

As shown in FIG. 3B, a positive photosensitive resin layer 9 is next formed on the substrate 1 having the energy generating elements 2. To form the positive photosensitive resin layer 9, a general solvent-coating method such as spin coating and slit coating can be applied. After the formation of the positive photosensitive resin layer 9, the positive photosensitive resin layer 9 is subjected to heat treatment.

Figure 3C:
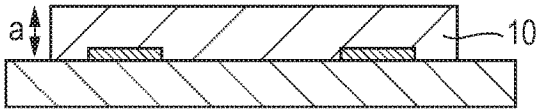

As shown in FIG. 3C, the positive photosensitive resin layer 9 is next exposed and developed to be patterned by a photolithographic process, thereby forming a mold material 10 having a pattern for an ink flow path 6. The mold material 10 preferably has a light absorbance of 0.2 or more, more preferably 0.3 or more, and even more preferably 0.4 or more, at a wavelength of 365 nm in the total thickness in the i-line irradiation direction (thickness direction).

When a mold material 10 has a total absorbance of less than 0.2 at 365 nm, an intended ejection port shape may not be obtained in a subsequent exposure step for forming ejection ports 5. When a mold material 10 having a total absorbance of less than 0.2 at 365 nm is subjected to pattern exposure to light at 365 nm for forming ejection ports 5, the reflected light from the substrate 1 affects the ejection port shape. It is thought that the affection of the reflected light interferes with the formation of a latent image pattern of an ejection port shape with the exposure.

The main component of the positive photosensitive resin used in the positive photosensitive resin layer 9 for forming the mold material 10 is preferably a photodegradable polymer compound or the like from the viewpoint of resolution or removability. Any photodegradable polymer compound usable for forming an intended mold material 10 can be used, and a vinyl ketone type polymer (vinyl ketone polymer) and an acrylic type polymer (acrylic polymer) such as polymethyl methacrylate can be used, for example. In particular, a vinyl ketone type polymer such as polymethyl isopropenyl ketone is suitably used, for example. Such a polymer preferably has a number-average molecular weight of 10,000 or more to 500,000 or less from the viewpoint of process durability.

A light absorbing agent is added to the positive photosensitive resin in order to adjust the absorbance of a mold material 10, and the mold material 10 containing the light absorbing agent is subjected to i-line exposure for forming ejection ports.

The light absorbing agent used in the present invention is a light absorbing agent that is nonvolatile at a baking temperature of the positive photosensitive resin layer 9 for forming the mold material 10, or at a heating temperature at the time of the above heat treatment. A light absorbing agent absorbing i-line is used.

As for the nonvolatility of a light absorbing agent, any light absorbing agent that does not volatile at a temperature when the positive photosensitive resin layer 9 is heated (prebaked) can be used. In other words, when a vinyl ketone type or acrylic type polymer or the like is used as the positive photosensitive resin, the prebaking temperature is typically 120° C. or less, at most 150° C. or less, and thus the light absorbing agent having sufficient nonvolatility not to volatile at the prebaking temperature can be used. In other words, assuming that the temperature for heat treatment is 150° C., the light absorbing agent is preferably nonvolatile at the temperature. To evaluate the nonvolatility, for example, a thermogravimetric apparatus (TGA apparatus) is used to determine a weight loss. When a vinyl ketone type polymer is specifically used, a light absorbing agent having a weight loss of 1% or less after heating at 120° C. for 30 minutes is preferred. The temperature, 120° C., for the measurement can be changed in accordance with the upper limit of the prebaking temperature of the photosensitive resin component in a positive photosensitive resin. A light absorbing agent reaching a weight loss of 1% at a temperature of 200° C. or more when heated from room temperature is more preferred.

As for the absorption of i-line, the light absorbing agent preferably satisfies the following requirements.

The ratio of "an average light absorbance (a2) in a wavelength range of 280 nm or more to 330 nm or less" to "a light absorbance (a1) at a wavelength of 365 nm" (a2/a1) is regarded as absorbance ratio A. When the positive photosensitive resin contains a vinyl ketone type photodegradable polymer compound, the absorbance ratio A is preferably 1.0 or less.

The absorbance ratio A is more preferably 0.7 or less and even more preferably 0.5 or less.

The absorbance ratio A can be determined by the following procedure.

First, a solution of a light absorbing agent in any solvent is applied to the surface of a substrate for absorbance measurement, and the resulting solution film is dried to give a coating film. The coating film is used as the measurement film to determine "the light absorbance at a wavelength of 365 nm" and "the average light absorbance in a wavelength range of 280 nm or more to 330 nm or less" by a usual method using transmitted light or the like (usual transmitted light measurement). The average absorbance in a predetermined range is determined by the following procedure: the absorbance of the measurement film is measured at any wavelength intervals (for example, 1 nm) in the range, and the sum of the absorbances measured at wavelengths is divided by the number of measurement wavelengths.

When a light absorbing agent having an absorbance ratio A of more than 1.0 is used, a positive photosensitive resin layer 9 exhibiting strong light absorption in a wavelength range of 280 nm or more to 330 nm or less is formed. Especially when a positive photosensitive resin layer 9 mainly containing a vinyl ketone type photodegradable polymer compound exhibits strong light absorption in a wavelength range of 280 nm or more to 330 nm or less, the sensitivity or resolution of the positive photosensitive resin layer 9 deteriorate. Accordingly, the mold material 10 may not be formed in an intended shape.

This is thought to be for the following reason.

In other words, a vinyl ketone type photodegradable polymer compound or the like contained in the positive photosensitive resin layer 9 typically undergoes photodegradation reaction by light irradiation at a wavelength of 280 nm or more to 330 nm or less. If a positive photosensitive resin layer 9 contains a light absorbing agent to exhibit strong absorption in the wavelength range, the photodegradation reaction can be supposed to be suppressed.

As the light absorbing agent, a light absorbing agent capable of adjusting the light absorbance ($T_{Abs}$) of the whole mold material 10 in the thickness direction of the mold material 10 at a wavelength of 365 nm to 0.2 or more, preferably 0.3 or more, and more preferably 0.4 or more can be suitably used. The absorbance ($T_{Abs}$) may not have any particular upper limit, and the upper limit of the absorbance ($T_{Abs}$) can be set so as not to affect properties other than the light absorbability of the mold material 10.

The mixing ratio of the light absorbing agent in the positive photosensitive resin can be set so as to impart an intended absorbance to the mold material 10 in the total thickness direction, and can be determined in consideration of the type and absorption characteristics of a light absorbing agent used, the light transmittance of a positive photosensitive resin, the thickness of a mold material 10, and the like. For example, the light absorbing agent is preferably contained in a range of 0.5% by mass or more to 2.0% by mass or less relative to the positive photosensitive resin.

As for the measurement method of the absorbance of a mold material 10 in the total thickness, for example, a mold material 10 with an intended film thickness is formed on a quartz substrate to give a measurement sample, and the absorbance of the measurement sample is determined by an absorbance measurement method including a usual method using transmitted light or the like.

Any compound satisfying the properties of the above nonvolatility and the absorbance can be used as the light absorbing agent.

As specific examples of the light absorbing agent, at least one of compounds represented by Chemical Formula (1) can be used.

(1)

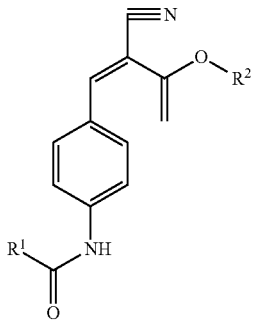

In Chemical Formula (1), $R^1$ and $R^2$ are substituted or unsubstituted hydrocarbon groups.

Examples of $R^1$ and $R^2$ include linear or branched alkyl groups having 1 to 8 carbon atoms, linear or branched alkyl groups having 1 to 8 carbon atoms and substituted with a carboxyl group, and linear or branched alkyl groups having 1 to 8 carbon atoms and substituted with a trimethylsilyl group.

$R^1$ and $R^2$ can also be a group represented by Chemical Formula (2):

(2)

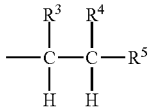

[in Chemical Formula (2), $R^3$ is a hydrogen atom or an ethyl group; $R^4$ is a hydrogen atom or an ethyl group; and $R^5$ is $—Si(CH_3)_3$ or $—(C_nH_{2n})—CH_3$ (n is an integer of 2 to 4)].

The alkylene group of $—(C_nH_{2n})—$ is preferably a linear alkylene group represented by $—(CH_2)_n—$.

Specific examples of $R^1$ and $R^2$ include the following groups.

A methyl group, an ethyl group, a propyl group, a butyl group, a 1-ethylpentyl group, a 2-ethylpentyl group, a 2-ethylhexyl group, a 1-butyl-pentyl group, a 2-carboxymethyl group, a 2-trimethylsilylethyl group, and a heptyl group.

Preferred combinations of $R^1$ and $R^2$ are shown in Table 1.

TABLE 1

| | $R^1$ | $R^2$ |
|---|---|---|
| Case 1 | $CH_3$ | $CH_3$ |
| Case 2 | $CH_3$ | $CH_2CH_3$ |
| Case 3 | $CH_3$ | $CH_2CH_2CH_3$ |
| Case 4 | $CH_3$ | $CH_2CH_2CH_2CH_3$ |
| Case 5 | $CH_2CH_3$ | $CH_2CH_3$ |
| Case 6 | $CH(CH_2CH_3)(CH_2CH_2CH_2CH_3)$ | $CH_2CH(CH_2CH_3)(CH_2CH_2CH_2CH_3)$ |
| Case 7 | $CH_2C(CH_3)_3$ | $CH_2CH(CH_2CH_3)(CH_2CH_2CH_2CH_3)$ |
| Case 8 | $CH_2CH_2COOH$ | $CH_2CH_3$ |
| Case 9 | $CH_2CH_2Si(CH_3)_3$ | $CH_2CH_3$ |
| Case 10 | $CH_2CH_2CH_2CH_2CH_2CH_2CH_3$ | $CH_2CH(CH_2CH_3)(CH_2CH_2CH_2CH_3)$ |

The groups of $R^1$ and $R^2$ represented by Chemical Formula (2) are moieties affecting the volatility of the compound represented by Chemical Formula (1) and the solubility in a solvent. Especially as for the volatility, for example, when the groups of $R^1$ and $R^2$ represented by Chemical Formula (2) are a methyl group, which has the shortest carbon chain, shown in case 1, the compound represented by Chemical Formula (1) has a boiling point of 485° C., which is sufficiently higher than the prebaking temperature. This indicates that any compound represented by Chemical Formula (1) having a group represented by Chemical Formula (2) other than the groups shown in Table 1 can also be used.

As a preferred case in Table 1, the compound represented by Chemical Formula (3) having the groups shown in case 10 can be exemplified.

The boiling point of the light absorbing agent is preferably higher than a temperature of baking treatment of the positive photosensitive resin layer 9, more preferably 50° C. or more, and even more preferably 100° C. or more.

(3)

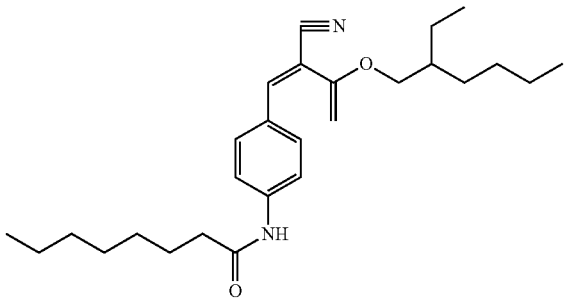

Figure 4:
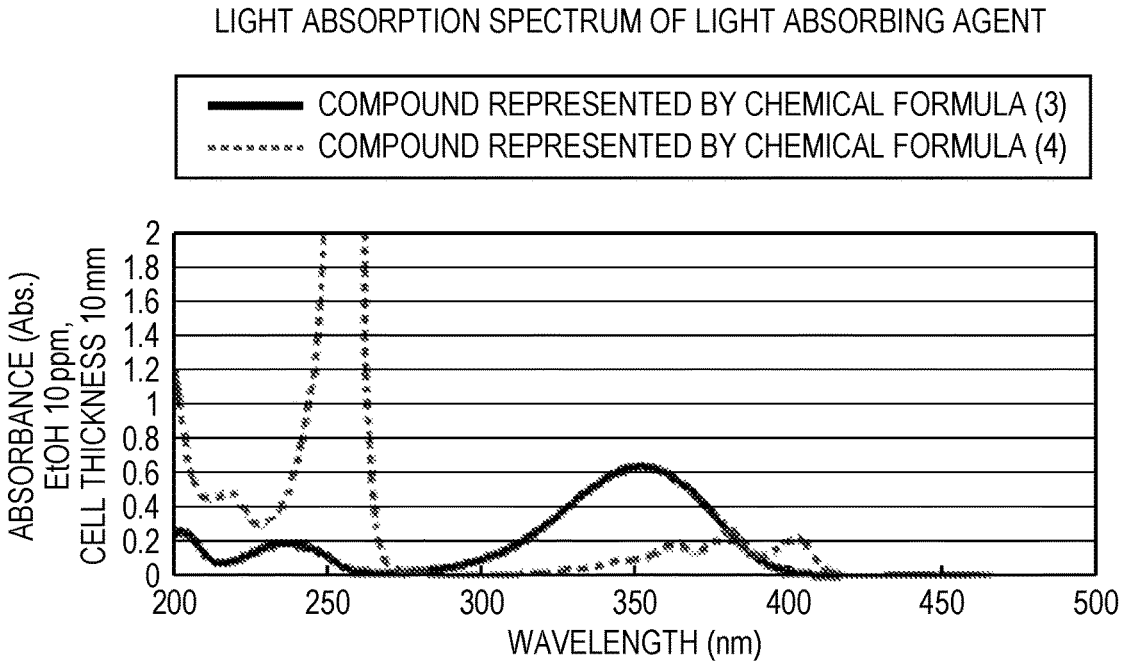
FIG. 4 is a graph showing light absorption spectra of light absorbing agents.

For reference, the light absorption spectrum of the compound represented by Chemical Formula (3) is shown in FIG. 4. The absorption spectrum was measured using a 10 ppm solution of the light absorbing agent in ethanol. FIG. also shows the absorption spectrum of 9,10-diethoxyanthracene represented by Chemical Formula (4) as a light absorbing agent.

The mold material 10 is not only composed of a single layer of a positive photosensitive resin layer but also can be a multilayer structure of the same material or a multilayer lamination structure including two or more layers of different materials.

The light source used for exposure of the positive photosensitive resin layer 9 into the mold material 10 is preferably a light source having irradiation intensity in a range of 280 nm or more to 330 nm or less from the viewpoint of processing accuracy and sensitivity of the positive photosensitive resin layer 9.

Figure 3D:
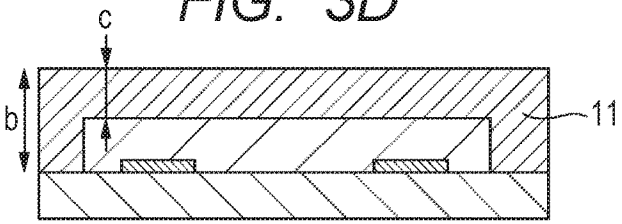

Next, the positive photosensitive resin layer 9 after exposure is developed with a developer to form a mold material 10 on the substrate 1, and then a negative photosensitive resin layer 11 to be a member 4 for forming ejection ports 5 and a flow path 6 is formed thereon as shown in FIG. 3D. The formation method is exemplified by spin coating, roll coating, and slit coating. A material of the negative photosensitive resin layer is required to have high mechanical strength as a structural material, adhesion to the underlayer, ink resistance, and resolution for fine patterning of ink ejection ports. As the material satisfying such characteristics, a cationic polymerizable epoxy resin composition can be suitably used.

As the epoxy resin, for example, a reaction product of bisphenol A and epichlorohydrin having a molecular weight of about 900 or more or a reaction product of bromine-containing bisphenol A and epichlorohydrin can be used. A reaction product of phenol novolac or o-cresol novolac and epichlorohydrin can also be used. Polyfunctional epoxy resins having an oxycyclohexane skeleton, disclosed in Japanese Patent Application Laid-Open No. S60-161973, Japanese Patent Application Laid-Open No. S63-221121, Japanese Patent Application Laid-Open No. S64-9216, and Japanese Patent Application Laid-Open No. H02-140219 are also exemplified. The epoxy resin is not limited to these compounds. Of the epoxy resins, a compound preferably having an epoxy equivalent of 2,000 or less, more preferably having an epoxy equivalent of 1,000 or less, is suitably used. This is because a compound having an epoxy equivalent of more than 2,000 gives a lower cross-linking density at the time of curing reaction to cause problems of adhesion or ink resistance in some cases.

As a photocationic polymerization initiator for curing the epoxy resin, a compound that generates an acid by photoirradiation can be used. Such a compound is not limited to particular compounds, and for example, an aromatic sulfonium salt or an aromatic iodonium salt can be used. The aromatic sulfonium salt is exemplified by TPS-102, -103, and -105, MDS-103, -105, -205, and -305, and DTS-102 and -103 commercially available from Midori Kagaku Co., Ltd. SP-170 and -172 commercially available from ADEKA Corporation is also exemplified. As the aromatic iodonium salt, DPI-105, MPI-103 and -105, and BBI-101, -102, -103, and -105 commercially available from Midori Kagaku Co., Ltd. can be suitably used, for example. The photocationic polymerization initiator can be added in such an amount as to give an intended sensitivity, and specifically, can be suitably used in a range of 0.5 to 5% by mass relative to the epoxy resin. As needed, SP-100 commercially available from ADEKA Corporation can be added as a wavelength sensitizer, for example.

In addition, additives and the like can be appropriately added to the negative photosensitive resin (composition) as needed. For example, a flexibilizer can be added in order to reduce the elastic modulus of an epoxy resin, or a silane coupling agent can be added in order to further improve the adhesion force to the underlayer.

Figure 3E:
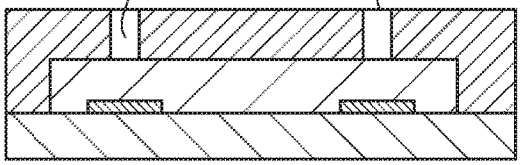

Next, pattern exposure is performed through a mask (not shown), and development treatment is performed, forming ejection ports 5 and ejection parts 7 as shown in FIG. 3E. The ejection ports 5 communicate with the mold material 10, and the ejection parts 7 reach the mold material 10. Concurrently with the development, the mold material 10 can also be dissolved and removed. For this exposure, i-line is used. The i-line is known to have a center wavelength of 365 nm and to have a half-width of about 5 nm. The irradiation device can be a commercially available i-line stepper.

Figure 3F:
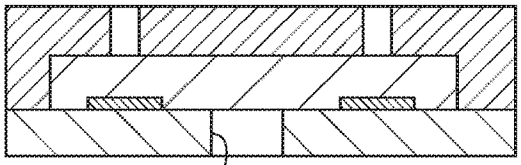

As shown in FIG. 3F, an ink supply port 3 penetrating the substrate 1 is next formed. The ink supply port 3 can be formed by anisotropic etching with an etching mask of a resin composition having etching solution resistance.

Figure 3G:
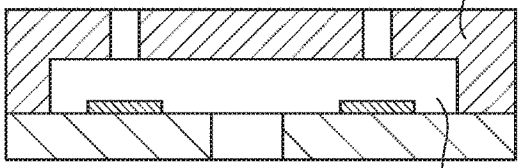

As shown in FIG. 3G, the mold material 10 is next removed from the substrate 1 to the outside, forming a flow path 6. As needed, heat treatment is performed, then a member for supplying an ink (not shown) is bonded, and electrical connection for driving the energy generating elements 2 (not shown) is performed, completing a recording head.

By using the method for producing a recording head according to the invention described above, an ink jet recording head in which ejection ports 5 and flow path 6 are formed with high precision can be produced.

The member 4 shown in FIGS. 3A to 3G can also be formed from the ejection port forming member 4-1 and the flow path forming member 4-2 shown in FIG. 2B. Such a structure having the ejection port forming member 4-1 and the flow path forming member 4-2 can be prepared by the following procedure, for example. Through the steps in FIGS. 3A to 3C, a mold material 10 is formed from a positive photosensitive resin layer 9 in a predetermined area on a substrate 1, and in the step in FIG. 3D, a negative photosensitive resin layer 11 to be a member constituting the flow path forming member 4-2 is stacked so as to cover the mold material 10. The negative photosensitive resin layer 11 is cured, and then the surface of the layer composed of the cured negative photosensitive resin is ground down so that the flow path forming member 4-2 and the surface of the mold material 10 form the same smooth surface. On the resulting smooth surface, a negative photosensitive resin layer 11 to be a member serving as the ejection port forming member 4-1 is stacked and cured, yielding the structure having the ejection port forming member 4-1 and the flow path forming member 4-2. The ejection port forming member 4-1 is required to have ejection ports 5 formed with high precision, whereas the flow path forming member 4-2 is required to have adhesion to the substrate 1. Hence, the method of forming the member 4 as the ejection port forming member 4-1 and the flow path forming member 4-2 can be suitably used for giving a structure in which each required performance is given to the corresponding member 4 and intended functional separation is performed between the members.

EXAMPLES

Example 1 and Comparative Example 1

«Evaluation of Nonvolatility of Light Absorbing Agent»

On a quartz substrate for absorbance measurement, a positive photosensitive resin composition shown in Table 2 was applied by spin coating and then was baked at 150° C. for 6 minutes, giving a positive photosensitive resin layer. The resin layer had a film thickness of 14 μm. In the preparation, the spin coating and the prebaking were performed by using a coater/developer CDS-860 manufactured by Canon without an exhaust function. The sample for absorbance measurement was used to measure the absorbance ($T_{Abs}$) at 365 nm of the resin layer in the total thickness direction by a usual method, and the absorbance ratio A was determined. The results are shown in Table 3.

The nonvolatility of each light absorbing agent shown in Table 3 was determined by the following procedure. First, about 5 mg of a light absorbing agent was heated at 120° C. for 30 minutes under a nitrogen atmosphere and was weighed with a TGA apparatus. From the weight change before and after the heating, the weight loss [%] was calculated. Separately, about 3 mg of a light absorbing agent was heated under a nitrogen atmosphere from 40° C. to 500° C. at a rate of 10° C./min and was weighed with a TGA apparatus during the temperature rise. From the obtained spectrum, the temperature when the weight loss reached 1% during the temperature rise was determined. The test results are collectively shown in Table 3.

TABLE 2

| | Positive photosensitive resin composition | | | | | |
|---|---|---|---|---|---|---|
| | Resin | | Light absorbing agent | | Solvent | |
| | Name | Amount (parts by mass) | Name | Amount (parts by mass) | Name | Amount (parts by mass) |
| Example 1 | PMIK | 20 | Compound of Chemical Formula (3) | 0.264 | Cyclohexane | 80 |
| Comparative Example 1 | PMIK | 20 | Compound of Chemical Formula (4) | 0.154 | Cyclohexane | 80 |

PMIK: Polymethyl isopropenyl ketone

TABLE 3

| Light absorbing agent | Absorbance ratio Absorbance ratio A | Weight loss due to volatility: Weight loss after heating at 120° C. for 30 minutes | Weight loss due to volatility: Temperature when weight loss reached 1% during temperature rise |
|---|---|---|---|
| Example 1 Compound of Chemical Formula (3) | 0.30 | 0.10% | 267° C. |
| Comparative Example 1 Compound of Chemical Formula (4) | 0.26 | 2.20% | 141° C. |

«Evaluation of Contamination to Apparatus»

On silicon substrates, a positive photosensitive resin composition shown in Table 2 was applied by spin coating and then was baked at 150° C. for 6 minutes, giving a positive photosensitive resin layer. The layer had a film thickness of 20 μm. In the preparation, the spin coating and the prebaking were performed by using a coater/developer CDS-860 manufactured by Canon without an exhaust function.

After a certain number of substrates were treated, the cover of the baking furnace of CDS-860 was detached, and the back surface of the cover was visually observed. The presence or absence of deposits on the back surface of the cover is shown in Table 4. The criteria are as shown below.

A: No deposit was observed on the back surface of the cover.

B: Deposits were observed on the back surface of the cover.

TABLE 4

| Number of treated wafers | 50 | 100 | 200 | 300 |
|---|---|---|---|---|
| Example 1 | A | A | A | A |
| Comparative Example 1 | A | B | — | — |

«Evaluation Results»

As shown in Table 4, in Comparative Example 1 in which the compound of Chemical Formula (4) was used as a conventional light absorbing agent, deposits were observed on the back surface of the cover after 100 substrates were treated. In contrast, in Example 1 of the present invention, no deposit was observed on the back surface of the cover even after 300 substrates were treated.

The deposits observed on the back surface of the cover in Comparative Example 1 were collected and subjected to GC-MS analysis, and the deposits were identified as the compound of Chemical Formula (4).

Example 2

«Evaluation of Pattern»

On a quartz substrate for absorbance measurement, a positive photosensitive resin composition shown in Table 5 was applied by spin coating and then was baked at 150° C. for 6 minutes, giving a positive photosensitive resin layer. The resin layer had a film thickness of 14 μm. In the preparation, the spin coating and the prebaking were performed by using a coater/developer CDS-860 manufactured by Canon without an exhaust function. The sample for absorbance measurement was used to measure the absorbance ($T_{Abs}$) at 365 nm of the resin layer in the total thickness direction by a usual method, and the absorbance ratio A was determined. The results are shown in Table 6.

TABLE 5

| | Positive photosensitive resin composition: Resin: Name | Resin: Amount (parts by mass) | Light absorbing agent: Name | Light absorbing agent: Amount (parts by mass) | Solvent: Name | Solvent: Amount (parts by mass) |
|---|---|---|---|---|---|---|
| Example 2 | PMIK | 20 | Compound of Chemical Formula (3) | 0.264 | Cyclohexane | 80 |
| Comparative Example 2 | PMIK | 20 | Benzophenone | 0.154 | Cyclohexane | 80 |
| Comparative Example 3 | PMIK | 20 | 3-Benzoylcoumarin | 0.154 | Cyclohexane | 80 |

PMIK: Polymethyl isopropenyl ketone

On a silicon substrate, a positive photosensitive resin layer was formed in the same manner as the sample for absorbance measurement. A mask for forming a 5-μm-width line-and-space pattern was used to perform pattern exposure at an exposure amount shown in Table 6 by using a Deep-UV exposure apparatus UX-3000 manufactured by USHIO Inc. The exposed layer was then developed with methyl isobutyl ketone and was rinsed with isopropyl alcohol. The formed pattern was observed under an optical microscope to determine the presence or absence of the pattern. The criteria are as shown below.

A: A 5-μm-width line-and-space pattern was observed.

B: No 5-μm-width line-and-space pattern was observed.

TABLE 6

| | Absorbance ratio Absorbance ratio A | Exposure amount ($mJ/cm^2$): 30000 | 35000 | 40000 | 45000 | 50000 |
|---|---|---|---|---|---|---|
| Example 2 | 0.3 | A | A | A | A | A |
| Comparative Example 2 | 8.5 | B | B | B | B | A |
| Comparative Example 3 | 5.1 | B | B | B | A | A |

«Evaluation Results»

As shown in Table 6, the resin layers of Comparative Examples 2 and 3 having an absorbance ratio A of more than 1.0 required exposure amounts of 50,000 mJ/cm$^2$ and 45,000 mJ/cm$^2$, respectively, in order to form the pattern. In contrast, in Example 2, the pattern can be formed at 30,000 mJ/cm$^2$.

Example 3

«Evaluation of Recording Head»

In accordance with the method described in FIGS. 3A to 3G, an ink jet recording head shown in FIG. 2A was produced.

First, a silicon substrate 1 having electrothermal conversion elements (heaters made from $HfB_2$) as the energy generating element 2 and a lamination film of SiN+Ta in an ink flow path formation area (not shown) was prepared (FIG. 3A).

On the substrate 1, a positive photosensitive resin composition (described as Example 1 in Table 2) was spin-coated by using a coater/developer CDS-860 manufactured by Canon and was baked at 120° C. for 3 minutes, forming a positive photosensitive resin layer 9. The positive photosensitive resin layer 9 formed on the substrate 1 had a film thickness of 14 μm (FIG. 3B).

Successively, the positive photosensitive resin layer 9 was patterned. A Deep-UV exposure apparatus UX-3000 manufactured by USHIO Inc. was used as the exposure apparatus to perform pattern exposure at an exposure amount of 30,000 mJ/cm$^2$. The exposed layer was then developed with methyl isobutyl ketone (MIBK) and was rinsed with isopropyl alcohol, forming a mold material 10 having a film thickness of 10 μm indicated by "a" in FIG. 3C (FIG. 3C).

Next, a negative photosensitive resin composition for forming ejection ports 5 and flow path 6 (described in Table 7) was spin-coated to form a negative photosensitive resin layer 11 (FIG. 3D). The negative photosensitive resin layer 11 had a film thickness of 20 μm on the substrate 1 ("b" in FIG. 3D) and a film thickness of 10 μm on the mold material 10 ("c" in FIG. 3D).

TABLE 7

| Negative photosensitive resin composition for forming ejection ports and flow path | | | | | |
|---|---|---|---|---|---|
| Epoxy resin | | Photocationic polymerization initiator | | Solvent | |
| Name | Amount (parts by mass) | Name | Amount (parts by mass) | Name | Amount (parts by mass) |
| EHPE-3150 manufactured by Daicel | 50 | SP-172 manufactured by ADEKA | 1 | MIBK | 50 |

Next, the negative photosensitive resin layer 11 was patterned in order to form ejection ports 5. An i-line stepper FPA-3000i5+ manufactured by Canon was used as the exposure apparatus to perform pattern exposure at an exposure amount of 5,000 J/m$^2$. The exposed layer was then developed with methyl isobutyl ketone, rinsed with isopropyl alcohol, and heated at 100° C. for 60 minutes. Consequently, ejection parts 7 having ejection ports 5 were formed (FIG. 3E). In the example, a circular pattern mask was used as the ejection port pattern mask for the exposure. Even after the exposure and the development for forming ejection ports, the mold material 10 was not developed and still had the original shape.

Next, an etching mask (not shown) was formed on the back surface of the substrate to be treated, and the silicon substrate was subjected to anisotropic etching to form an ink supply port 3 (FIG. 3F). In order to protect the ejection port forming surface against the etching solution during the etching, a protective film (OBC manufactured by Tokyo Ohka Kogyo Co., Ltd.) was applied onto the negative photosensitive resin layer 11.

Next, the protective film was dissolved and removed by xylene, then entire exposure was performed through the negative photosensitive resin layer 11 by using a Deep-UV exposure apparatus UX-3000 manufactured by USHIO Inc. at an exposure amount of 250,000 mJ/cm$^2$, and the mold material 10 was solubilized. The product was successively immersed in methyl lactate while being sonicated, and the mold material 10 was dissolved and removed (FIG. 3G).

Consequently, a recording head for ink jet was produced.

The following characteristics of the produced recording head were evaluated. The characteristics and the evaluation methods therefor are shown below.

[Absorbance ($T_{Abs}$) at 365 nm of Mold Material in Total Thickness Direction]

The positive photosensitive resin composition described as Example 1 having a formulation shown in Table 2 was used to form a mold material 10 (thickness: 10 μm) on a quartz substrate for absorbance measurement in the same manner as in the steps shown in FIGS. 3A to 3C, giving a sample for absorbance measurement. The sample for absorbance measurement was used to determine the absorbance ($T_{Abs}$) at 365 nm of the mold material 10 in the total thickness direction by a usual method. The measurement result is shown in Table 8.

[Ejection Port Shape]

The ejection port shape was observed on the ejection port surface of the recording head under a scanning electron microscope. Evaluation was performed by comparing the ejection port shape with the mask shape (circular shape) used for exposure to form the ejection ports. The criteria are as shown below.

A: The ejection port shape was almost the same circular shape as the mask shape.

B: The ejection port shape differed from the mask shape and was a distorted circular shape.

[Reproducibility of Ejection Port Shape]

In the example, 500 recording heads were produced, and 10 ejection port shapes of each recording head were observed to determine the difference in shape among the recording heads. The criteria are as shown below.

A: All the 500 recording heads had substantially the same ejection port shape.

B: Different ejection port shapes were observed in 20% or less recording heads as compared with the ejection port shape of the other recording heads.

C: Different ejection port shapes were observed in more than 20% recording heads as compared with the ejection port shape of the other recording heads.

[Geometric Accuracy of Mold Material]

In the production process of the recording head, the substrate 1 after formation of the mold material 10 (FIG. 3C) was observed under an optical microscope and a scanning electron microscope to evaluate the formation state of the mold material 10, or the geometric accuracy of the flow path 6. The criteria are as shown below.

A: No residue was observed on the entire surface of the substrate, and a clear pattern of the mold material 10 was formed.

B: Residues were observed on a part of the substrate.

C: Residues were observed on the entire surface of the substrate.

[Removability of Mold Material]

In the production process of the recording head, the substrate 1 after removal of the mold material 10 (FIG. 3G) was observed under an optical microscope and a scanning electron microscope to evaluate a residual mold material 10. The criteria are as shown below.

A: No residual mold material was observed on the entire surface of the substrate 1, and a clear ink flow path was formed.

B: A residual mold material was observed on a part of the substrate 1.

C: A residual mold material was observed on the entire surface of the substrate 1.

[Reliability Test of Recording Head]

An ink containing pure water/diethylene glycol/isopropyl alcohol/lithium acetate/black dye food black 2=79.4/15/3/0.1/2.5 (in terms of mass) was prepared. In the ink, the completed recording head was immersed at 60° C. for 3 months, and the joining state between the member 4 and the substrate 1 was evaluated. The criteria are as shown below.

A: In the entire area of the recording head, no detachment of the member 4 from the substrate 1 was observed.

B: In less than 50% area of the entire area of the recording head, detachment of the member 4 from the substrate 1 was observed.

C: In 50% or more area of the entire area of the recording head, detachment of the member 4 from the substrate 1 was observed.

[Contamination of Baking Apparatus]

The back surface of the cover of the baking furnace in the coater/developer CDS-860 manufactured by Canon used for forming the positive photosensitive resin layer 9 was observed. The criteria are as shown below.

A: No deposit was observed on the back surface of the cover.

B: Deposits were observed on the back surface of the cover.

«Evaluation Results»

The evaluation results of the recording head in Example 3 are shown in Table 8.

TABLE 8

| | Example 3 |
|---|---|
| Absorbance at 365 nm of mold material in total thickness direction | 0.45 |
| Ejection port shape | A |
| Reproducibility of ejection port shape | A |
| Geometric accuracy of mold material | A |
| Removability of mold material | A |
| Reliability of recording head | A |
| Contamination of baking apparatus | A |

As shown in Table 8, in the recording head produced in Example 3, the ejection port shape, the reproducibility of the ejection port shape, the geometric accuracy of the mold material, the removability of the mold material, and the reliability of the recording head were satisfactory. In addition, no contamination of the production apparatus was observed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-247025, filed Dec. 20, 2016, which is hereby incorporated by reference herein in its entirety.

What is claimed is:

1. A method for producing a liquid ejection head that includes a member having an ejection port and a flow path communicating with the ejection port and a substrate having an energy generating element configured to eject a liquid supplied from the flow path through the ejection port, the method comprising:

a step of providing a positive photosensitive resin layer on a substrate;

a step of heat-treating the positive photosensitive resin layer on the substrate;

a step of forming a mold material having a pattern of the flow path by subjecting the heat-treated positive photosensitive resin layer on the substrate to exposure and development;

a step of covering the mold material on the substrate with a negative photosensitive resin layer for forming the member;

a step of forming the ejection port communicating with the mold material by subjecting the negative photosensitive resin layer covering the mold material to i-line irradiation and development treatment; and a step of forming the flow path communicating with the ejection port by removing the mold material from the substrate, wherein the positive photosensitive resin layer includes a light absorbing agent that is nonvolatile at a temperature of the heat treatment of the positive photosensitive resin layer, and the light absorbing agent has "a light absorbance (a1) at a wavelength of 365 nm" and "an average light absorbance (a2) in a wavelength range of 280 nm or more to 330 nm or less", and an absorbance ratio A is 1.0 or less where the absorbance ratio A is a ratio a2/a1.

2. The method for producing a liquid ejection head according to claim 1, wherein the mold material has a light absorbance of 0.2 or more at a wavelength of 365 nm in a total thickness in an i-line irradiation direction.

3. The method for producing a liquid ejection head according to claim 1, wherein the light absorbing agent has a boiling point higher than a temperature of the heat treatment of the positive photosensitive resin layer.

4. The method for producing a liquid ejection head according to claim 1, wherein the light absorbing agent is at least one of compounds represented by Chemical Formula (1):

(1)

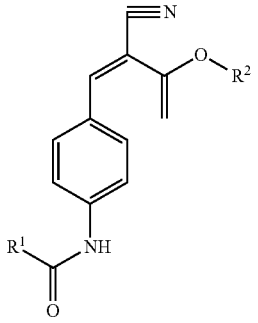

(in Chemical Formula (1), $R^1$ and $R^2$ are substituted or unsubstituted hydrocarbon groups).

5. The method for producing a liquid ejection head according to claim 4, wherein at least one of $R^1$ and $R^2$ is selected from linear or branched alkyl groups having 1 to 8 carbon atoms, linear or branched alkyl groups having 1 to 8 carbon atoms and substituted with a carboxyl group, and linear or branched alkyl groups having 1 to 8 carbon atoms and substituted with a trimethylsilyl group.

6. The method for producing a liquid ejection head according to claim 4, wherein at least one of $R^1$ and $R^2$ is selected from groups represented by Chemical Formula (2):

(2)

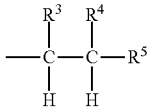

(in Chemical Formula (2), $R^3$ is a hydrogen atom or an ethyl group; $R^4$ is a hydrogen atom or an ethyl group; $R^5$ is $—Si(CH_3)_3$ or $—(C_nH_{2n})—CH_3$; and n is an integer of 2 to 4).

7. The method for producing a liquid ejection head according to claim 5, wherein $R^1$ and $R^2$ are selected from a methyl group, an ethyl group, a propyl group, a butyl group, a 1-ethylpentyl group, a 2-ethylpentyl group, a 2-ethylhexyl group, a 1-butyl-pentyl group, a 2-carboxymethyl group, a 2-trimethylsilylethyl group, and a heptyl group.

8. The method for producing a liquid ejection head according to claim 6, wherein the light absorbing agent is a compound represented by Chemical Formula (3):

(3)

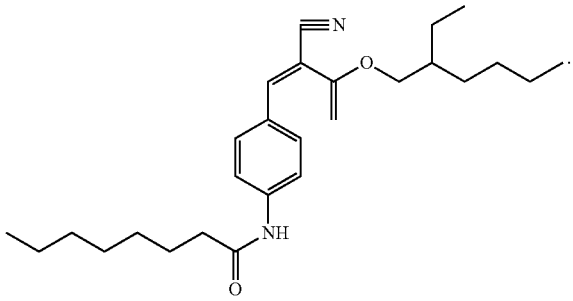

9. The method for producing a liquid ejection head according to claim 1, wherein the positive photosensitive resin layer includes a vinyl ketone polymer or an acrylic polymer.

10. The method for producing a liquid ejection head according to claim 9, wherein the positive photosensitive resin layer includes polymethyl isopropenyl ketone.

11. The method for producing a liquid ejection head according to claim 1, wherein the heat treatment is performed at a temperature of 150° C. or less.

12. The method for producing a liquid ejection head according to claim 1, wherein the light absorbing agent is contained in an amount of 0.5% by mass or more to 2.0% by mass or less relative to the positive photosensitive resin layer.

* * * * *